US011273572B2

(12) United States Patent
Perini et al.

(10) Patent No.: US 11,273,572 B2
(45) Date of Patent: Mar. 15, 2022

(54) PAPER CONVERTING PLANT

(71) Applicant: FUTURA S.P.A., Capannori (IT)

(72) Inventors: Fabio Perini, Viareggio (IT); Giovacchino Giurlani, Capannori (IT); Andrea Catalini, Porcari (IT)

(73) Assignee: FUTURA S.P.A., Capannori (IT)

( * ) Notice: Subject to any disclaimer, the term of this patent is extended or adjusted under 35 U.S.C. 154(b) by 193 days.

(21) Appl. No.: 16/642,144

(22) PCT Filed: Oct. 9, 2018

(86) PCT No.: PCT/IT2018/050187
§ 371 (c)(1),
(2) Date: Feb. 26, 2020

(87) PCT Pub. No.: WO2019/077639
PCT Pub. Date: Apr. 25, 2019

(65) Prior Publication Data

US 2020/0353638 A1 Nov. 12, 2020

(30) Foreign Application Priority Data

Oct. 18, 2017 (IT) ..... 102017000117533

(51) Int. Cl.
*B65H 18/16* (2006.01)
*B26D 7/18* (2006.01)
(Continued)

(52) U.S. Cl.
CPC ..... *B26D 7/1863* (2013.01); *B65H 18/16* (2013.01); *B65H 19/2269* (2013.01);
(Continued)

(58) Field of Classification Search
CPC ..... B65H 18/00; B65H 18/16; B65H 19/22; B65H 19/26; B65H 19/2269; B65H 2406/31; B65H 2408/235
See application file for complete search history.

(56) References Cited

U.S. PATENT DOCUMENTS 4,723,724 A * 2/1988 Bradley ..... B65H 19/2253 242/521
5,499,779 A * 3/1996 Raudaskoski ..... B65H 18/20 242/541.4
(Continued)

FOREIGN PATENT DOCUMENTS

DE 1 928 966 A1 2/1970
DE 295 12 151 U1 9/1995
(Continued)

OTHER PUBLICATIONS

International Search Report and Written Opinion of the International Searching Authority dated Feb. 12, 2019 in corresponding International application No. PCT/IT2018/050187; 8 pages.

*Primary Examiner* — Sang K Kim
(74) *Attorney, Agent, or Firm* — Maier & Maier, PLLC

(57) ABSTRACT

Paper converting plant including a rewinder adapted to produce paper logs and having an inlet for feeding a paper web, a winding station where the logs are formed and an exit station for unloading the finished logs. The rewinder has walls delimiting a chamber inside which the logs are formed, and an air suction channel at a lower part of chamber. The suction channel exerts a suction causing the formation of an air flow directed from the top to the bottom inside the chamber. The chamber includes two semi-chambers communicating with the air suction channel such that a vertical air flow directed downwards is generated in each of them, the chamber being provided with a manner for regulating the
(Continued)

vertical air flows providing vertically oriented identical air flow rates in the semi-chambers.

14 Claims, 5 Drawing Sheets

(51) Int. Cl.
*B65H 19/22* (2006.01)
*B65H 19/26* (2006.01)

(52) U.S. Cl.
CPC ..... *B65H 19/26* (2013.01); *B65H 2406/31* (2013.01); *B65H 2408/235* (2013.01)

(56) References Cited

U.S. PATENT DOCUMENTS

| | | | | |
|---|---|---|---|---|
| 11,158,465 | B2 * | 10/2021 | Kaito | H01G 13/04 |
| 2003/0015621 | A1 * | 1/2003 | Ohshio | B65H 16/106 242/528 |
| 2009/0001210 | A1 * | 1/2009 | Morelli | B65H 19/2269 242/521 |
| 2015/0165749 | A1 * | 6/2015 | Tamagaki | B65H 41/00 156/499 |
| 2015/0176118 | A1 | 6/2015 | Tamagaki et al. | |

FOREIGN PATENT DOCUMENTS

| | | | |
|---|---|---|---|
| EP | 0 183 863 | A1 | 6/1986 |
| EP | 0 631 954 | A2 | 1/1995 |
| EP | 1 700 805 | A2 | 9/2006 |

* cited by examiner

PAPER CONVERTING PLANT

FIELD

The present invention relates to a paper converting plant. In particular, an installation according to the present invention comprises a rewinder particularly designed to reduce the drawbacks associated with the formation of dust, scraps and other processing residues.

BACKGROUND

It is known that the production of logs made of paper material, from which are obtained, for example, rolls of toilet paper or rolls of kitchen paper, implies the feeding of a paper web, formed by one or more superimposed plies, on a predetermined path along which various operations are performed before proceeding to the formation of the logs, including a transversal pre-cut of the paper web to form pre-cut lines which divide it into detachable sheets. The production of the paper logs normally involves the use of cardboard tubes, commonly called "cores", on whose surface a predetermined amount of glue is distributed to allow the paper web to be bonded onto the cores gradually introduced into the machine which produces the logs, commonly called "rewinder". The glue is distributed on the cores when they pass along a path comprising an end section commonly known as "cradle" due to its concave shape. The production of the logs also implies the use of winding rollers which provoke the rotation of each core about its longitudinal axis thus determining the winding of the web on the core. The process ends when a predetermined number of sheets is wound on the core, with the gluing of a flap of the last sheet on the underlying one of the roll thus formed (so-called "flap gluing" operation). Upon reaching the predetermined number of sheets wound on the core, the last sheet of the log being completed is separated from the first sheet of the next log, for example by a jet of compressed air directed towards a corresponding pre-cutting line. At this point, the log is downloaded from the rewinder, EP1700805 discloses a rewinding machine working according to the scheme described above. The logs thus produced are then conveyed to a buffer store unit which supplies one or more cutting-off machines through which the transverse cutting of the logs is carried out to obtain the rolls inn the desired length.

The operations described above determine the formation of dust, trimmings and scraps of paper or cardboard. In practice, process residues are formed which can compromise the correct functioning of the machines and must be eliminated. Moreover, some types of paper carry non-negligible quantities of dust even if not subjected to other process steps before being wound in the rewinder.

SUMMARY

The main object of the present invention is to allow an efficient treatment of the residues produced by the processing of paper webs in paper converting plants.

One of the advantages of the invention is the elimination, or at least the drastic reduction, of the aforementioned processing residues in the machines of a paper converting plant; another advantage is that the efficiency of the system is increased due to the reduced possibility of failures and/or stops of the machines provoked by said residues; another advantage relates to the improved operating conditions of the motors, which can be advantageously arranged outside the area affected by the formation and accumulation of the residues: this determines a longer life of the motors and a more efficient sizing thereof; a further advantage is related to the improved working conditions for the operators due to the elimination, or at least the considerable reduction, of the dust present in the working environments near the machines; another advantage can be identified in the qualitative improvement of the product produced by the plant due to the reduced possibility of mixing of any residues with the product leaving the machine; another advantage relates to the constructive simplicity of the present solution, that provides innovative features even by means of relatively small modifications to the pre-existing machines or systems.

BRIEF DESCRIPTION OF THE DRAWINGS

These and further advantages of the present invention will be more evident from the following description and the attached drawings, given by way of example but not to be interpreted in a limiting sense, in which.

DETAILED DESCRIPTION

Figure 1:
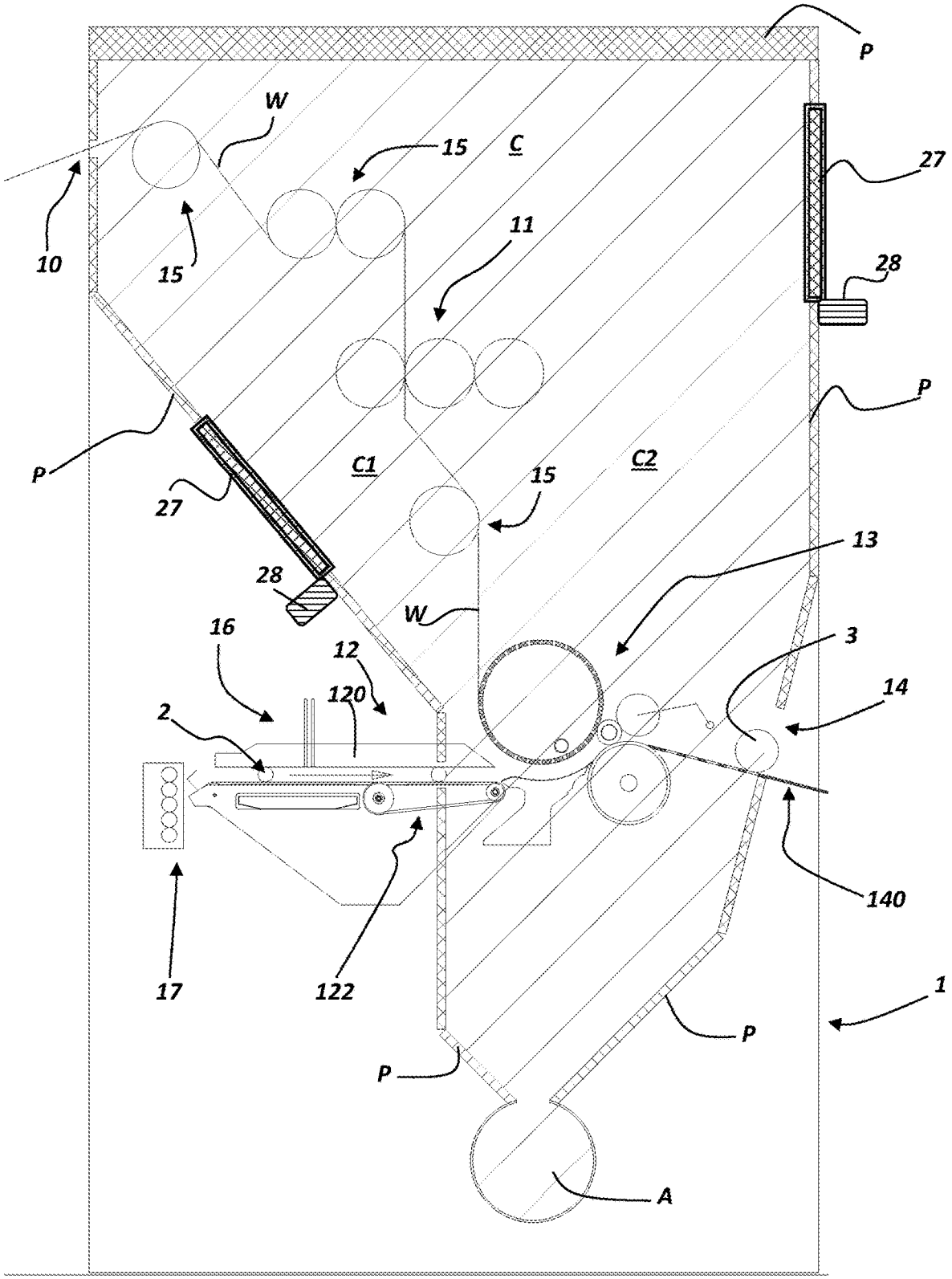
FIG. 1 is a schematic side view with parts removed of a possible embodiment of a rewinding machine of a plant according to the invention.

In the examples described below, reference is made to a rewinder (1) located in a paper converting plant (100) made according to the invention. The plant (100) generally comprises further machines in addition to the rewinder, such as, for example, one or more unwinders and an embosser arranged upstream of the rewinder, a cutting machine placed downstream of the rewinder, etc., of which the function and the structure are known.

The structure and general operation of the rewinder will be described in a simplified manner since they are known.

The rewinder (1) has an inlet (10) for feeding a paper web (W) that is made up of one or more superimposed plies. For example, said web (W) comes from an embosser located upstream of the rewinder (1). Along a path followed by the paper web inside the machine (1), pre-cutting means (11) are provided, which are adapted for making a discontinuous transversal cut of the web (W) to form the pre-cut lines which define the detachable paper sheets and facilitate the use of the finished product. In the drawings, the reference numeral (15) denote the web guiding rollers that, in a known manner, define the path followed by the paper web (W) inside the rewinder (1).

The rewinder (1) has another inlet (12) for the cardboard tubular cores (2), on the surface of which a predetermined amount of glue is applied, in a known and therefore not described way, to allow the gluing of the paper web on the cores progressively introduced into the rewinder. The reference numerals (16) and (17) denote the units for gluing and inserting the cores the machine (1); moreover, the reference numerals (122) and (120) indicate, respectively, conveyor belts (122) and guides (120) that are used for the insertion of the cores (2) and are arranged in a known manner, to support the cores (2) while they move within the rewinder (1).

The formation of the logs is carried out in a winding station (13) thanks to the use of winding rollers (13*a*,13*b*, 13*c*) which oblige each core to rotate about its longitudinal axis thus determining the winding of the paper on the core. The process ends when a predetermined number of sheets is wound on the core. A subsequent operation may consist in the gluing of a flap of the last sheet on the underlying one of the roll thus formed (so-called "flap gluing" operation).

Upon reaching the predetermined number of sheets wound on the core, the last sheet of the log being completed is separated from the first sheet of the next log, for example by a jet of compressed air directed towards a corresponding pre-cutting line. At this point, the log (3) is unloaded from the rewinding machine through a discharge station along which the completed log is discharged through an outlet (14) where a discharge plane (140) is provided.

According to the invention, the rewinding machine (1) is provided with a plurality of walls (P) that surround the equipment and devices which form part of the rewinder (1) so as to define a containment chamber (C), also called suction chamber in the following of the present description. Said chamber (C) is shown in broken lines in FIGS. 1, 3 and 4, for a better identification thereof. With reference to the example shown in the drawings, the equipment and devices of the rewinder include the guiding rollers (15), the pre-cutting means (11) and the winding rollers (13*a*, 13*b*, 13*c*).

Figure 2:
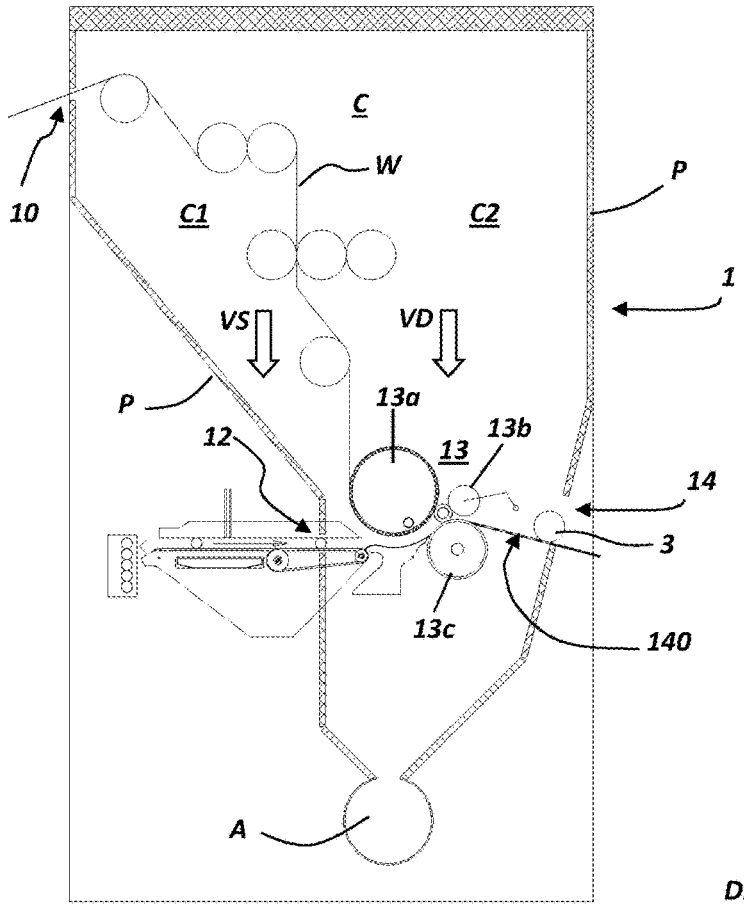
FIG. 2 shows the machine of FIG. 1 in a simplified view to better highlight a suction chamber made according to the invention.
Figure 3:
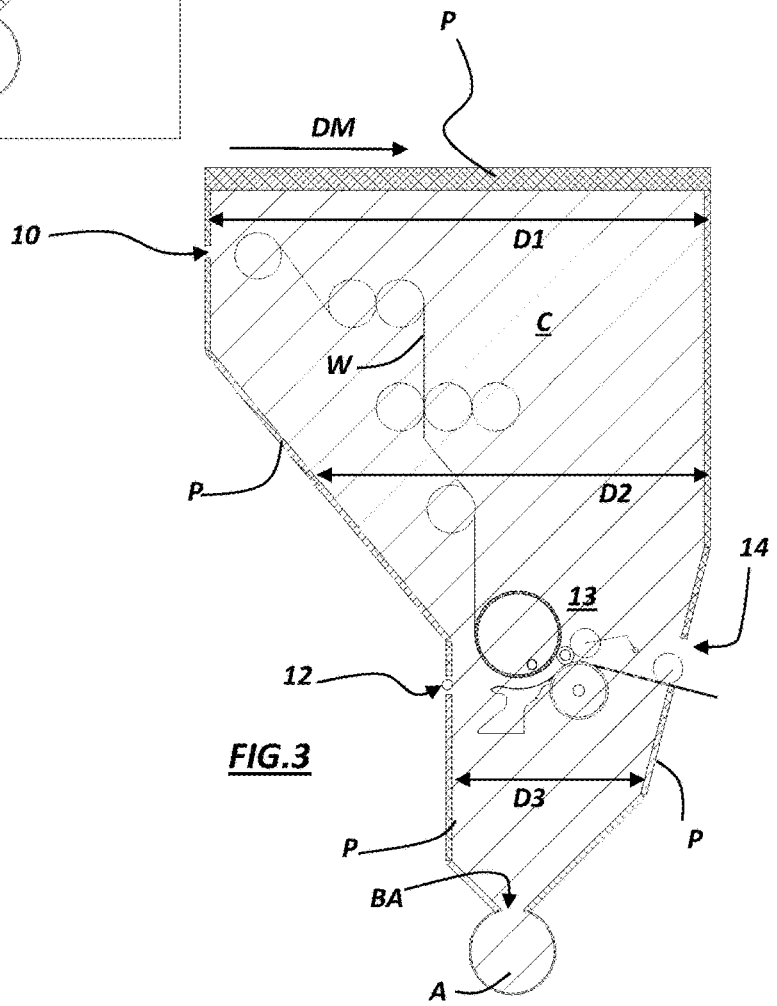
FIG. 3 shows the machine of FIG. 1 in a simplified view to better highlight a suction chamber made according to the invention.

In practice, the rewinder (1) is made as a traditional rewinder, but the areas which are usually open, or permeable to air, are closed by the walls (P), determining the formation of the suction chamber (C), which is not "under vacuum" in a literal sense due to the presence of the openings (10, 12, 14) for the entry of the material used for the production of logs and the exit of the finished logs, but nevertheless allows to optimize the suction action as further described below. In other words, thanks to an appropriate control of air flows, the uncontrolled dispersion of the residues associated with the movement and processing of the paper web (W) is prevented, said residues being retained inside the chamber (C) and advantageously eliminated through the suction channel (A) described below. The latter determines the production of air flows directed from top to bottom in the chamber (C). FIGS. 1, 2, 3 show the profile presented by the walls (P), which are inclined towards the bottom of the suction chamber so as to define inclined planes each having a given uniform slope and being oriented towards the lower base of the rewinder (1). In practice, the individual walls (P) have each a uniform slope so as they do not retain residues directed downwards. The walls (P) are inclined in substantial reciprocal approach so as to define a narrow groove at the bottom of the suction chamber where the suction channel (A) is provided. In FIG. 3 the decrease in the width of the chamber (C) is represented by the dimensions (D1), (D2) and (D3), decreasing from top to bottom. Said dimensions (D1, D2, D3) refer to the input direction (DM) of the materials used for making the logs. These decreasing dimensions of the chamber (C) from top to bottom determines a corresponding increase in the speed of the airflow directed downward. This is an advantage since the downward air speed will be lower inn the upper part of the chamber (C), where there is the web (W), while it will be greater in the lower area of the chamber (C) where the air directed downwards interacts only with the residues to be removed. Between the two zones of maximum and minimum speed of the downward airflow there is an intermediate speed zone where the air interacts with the logs in formation, which is less subject to possible damages than the web (W).

Figure 5:
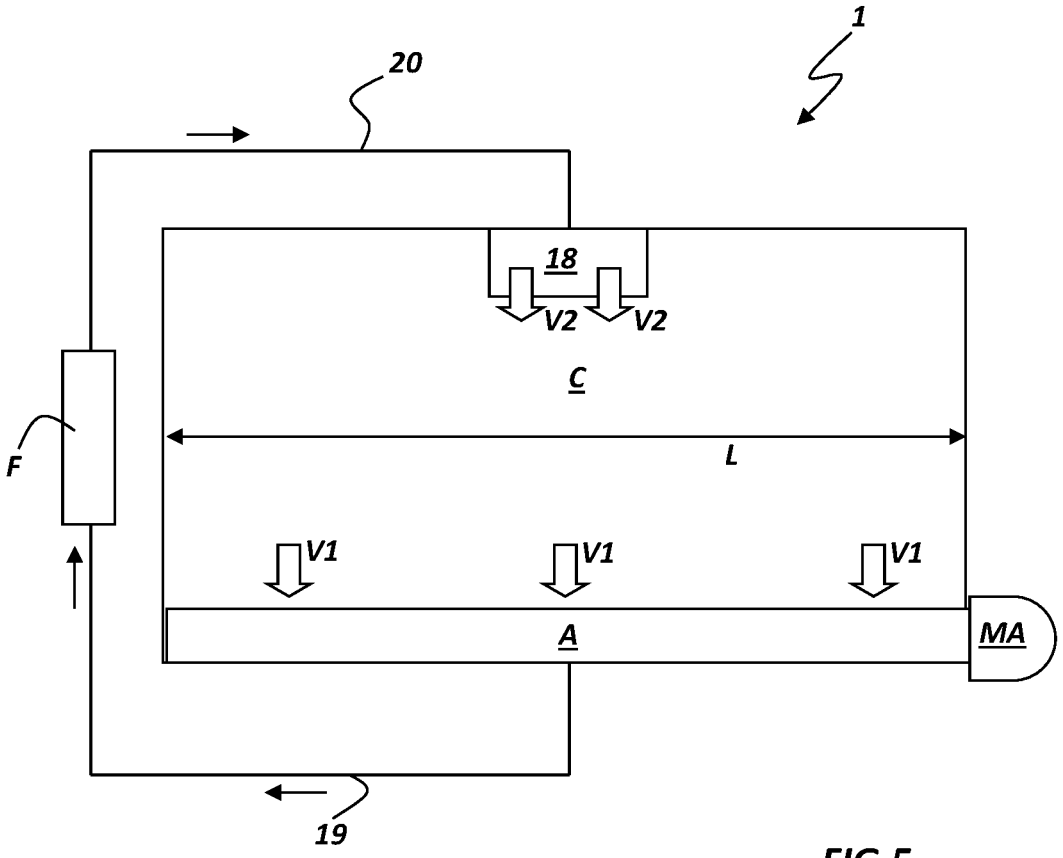
FIG. 5 is a diagram relating to the connection between some parts of a rewinding machine forming part of the plant.

In the lower part suction chamber (C) there is a suction channel (A) which extends transversely with respect to the rewinding machine (1) substantially along all the lower part thereof. In practice, the lower base of the rewinder (1) is provided with a suction channel (A) that is connected to suction means (MA) which in FIG. 5 are represented by a schematic block and which can be constituted by suitable air moving means such as, for example, fans, aspirators, etc. The arrows (VI) in the lower part of the chamber (C) schematically represent the direction of the airflow provoked by the suction channel.

In other words, along the entire width of the machine (1) extends the suction mouth (BA) of the channel (A) which exerts its action downwards, sucking the air and the residues contained therein, and which is open upward. In practice, the mouth (BA) of the suction channel (A) is an opening of the latter communicating with the suction chamber (C), said opening extending along the upper part of the channel (A).

The fact that the suction channel (A) is provided inn the lower base of the rewinder (1), i.e. inn the lower part of the suction chamber (C), improves the suction because the action of gravity on the residues to be eliminated is added to that of the suction, also directed downwards. The extension of the suction channel (A) according to the width of the rewinder further contributes to the optimization of the suction action.

The suction channel (A) can be connected to a filtering device (F) to filter the sucked air from the chamber (C). In FIG. 5 the suction channel (A) is connected via a duct (19) to a filtering device (F). The air drawn in by the chamber (C) is then filtered before being released into the environment surrounding the rewinder (1) or, as shown in the drawing, before being partly introduced back into the chamber (C). Advantageously, the filter (F) is connected through the duct (20) to an inlet (18) located in an upper area of the chamber (C). In this way, a part of the air drawn in from the bottom by the channel (A) and filtered by the filter (F) is introduced into the suction chamber (C) through the inlet (18). Therefore, a combined action of the flows (V2) coming from the top and moving downwards and of the flows (VI) conveying the residues downwards is obtained.

Figure 6:
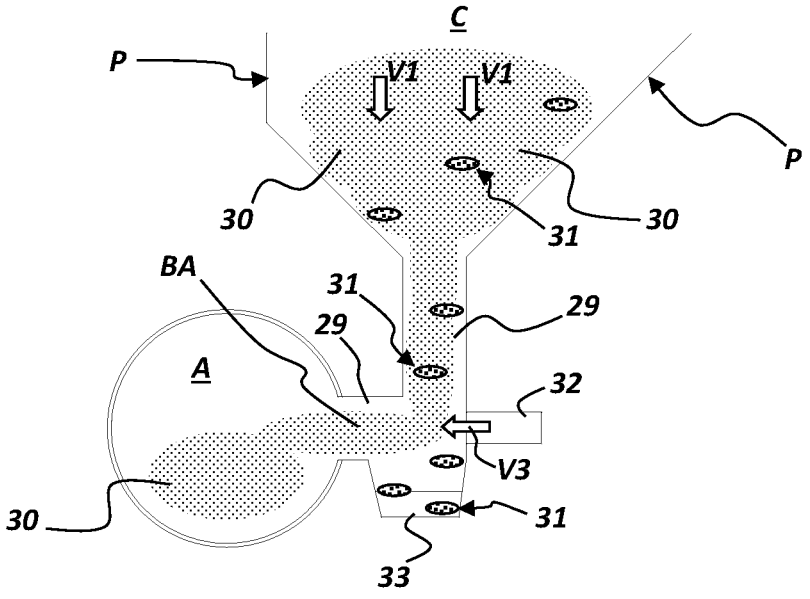
FIG. 6 is a partial, schematic side view of a possible embodiment of a lower portion of a machine made according to the invention.

FIG. 6 shows another possible embodiment of the invention with regard to the suction channel (A). FIG. 6 schematically shows the lower part of the suction chamber (C), which, in this example, has a lower connecting channel (29) which connects the suction chamber (C) to the channel (A) and the latter is arranged laterally with respect to the exit direction of the residues from the suction chamber (C). For example, the connecting channel (29) has a curved shape and there is an angle of about 90° between its proximal portion connected to the chamber (C) and its distal portion connected to the suction channel (A). The lower part of the channel (29) communicates with an underlying container (33) open on the top.

Openings (not shown in the drawings) can be provided on the channel (29) to facilitate the introduction of a flow (V3) of external air directed towards the suction channel (A). The amplitude of the aforesaid openings can possibly be adjusted by means of a gate valve schematically indicated with the reference "32" in FIG. 6. In practice, with reference to the example shown in FIG. 6, the residues discharge channel (29) forms an "L" with its longer arm connected to the chamber (C) and the shorter arm ending in the channel (A); the flow (V3) can favor the entry of residues of smaller mass and dimensions in the channel (A), allowing the residues having larger mass or dimensions to continue their run downwards.

With reference to the configuration shown in FIG. 6, the residues (30), (31) are pushed and/or aspirated downwards according to the flow indicated with (VI) to reach the channel (29). Once inside the channel (29), the heaviest residues, indicated with (31) in the example, are directed downwards into the container (33), because on them the force of gravity (and the possible contribution of thrust VI) is prevalent with respect to the flow (V3) while the lighter and/or smaller residues (30) are directed to the suction channel (A). The heaviest residues (31) may be, for example, larger residues of paper material or pieces of glue. The lightest/smallest residues (30) can be paper dust, powders of other materials, etc.

In other words, according to the invention, means for separating the residues can be provided, which in the example of FIG. 6 comprise the channel (29), the container (33) and optionally the openings made on the channel (29).

In the configuration of FIG. 6, the channel (A) is in a laterally offset position with respect to the suction chamber (C), so that the mouth (BA) is lateral. In this configuration, the plant can be provided with means which send an additional air flow (V3) towards the mouth (BA) of the channel (A) as previously said. This additional air flow (V3) does not pass through the suction chamber (C). It is believed that the use of the said additional air flow (V3) is advantageous when the distance between the mouth (BA) of the channel (A) and the residual outlet channel (29) is greater than a predetermined value, for example a value greater than 10 mm.

The walls of the chamber (C) can be provided with removable or openable doors (27) provided with relative activation means (28) which in FIG. 1 are shown schematically. The doors (27) can be constituted, for example, by hinged or sliding doors, and the relative activation means (28) can comprise, for example, handwheel, rack or other suitable devices. The presence of said doors allows access inside the machine when, for example, it is necessary to carry out maintenance operations, cleaning operations, eliminating material jams, and similar operations.

Figure 4:
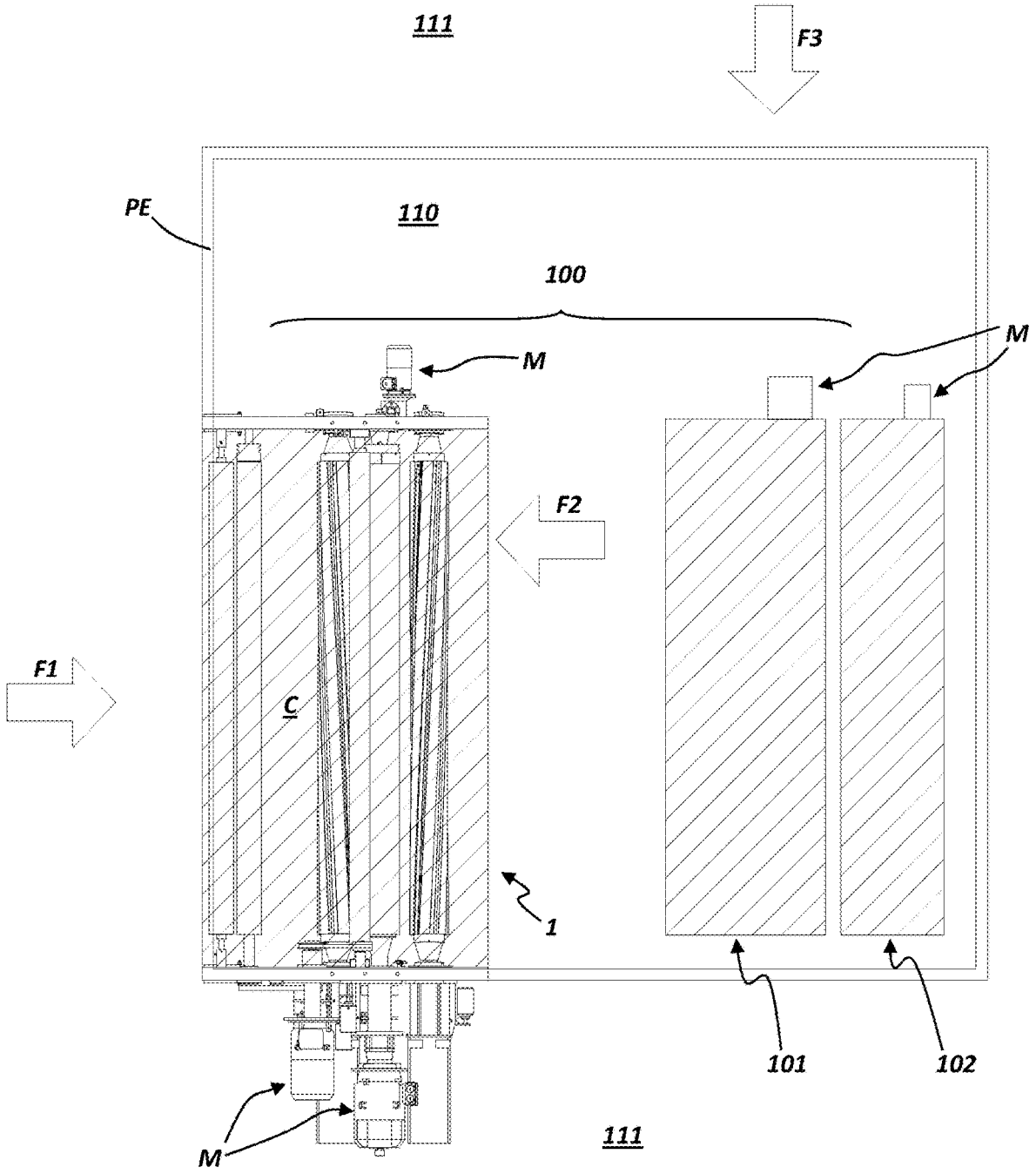
FIG. 4 shows in a schematic way the connections provided in a plant realized according to the invention; this drawing schematically represents an industrial warehouse inside which there is a cabin enclosing the machines of the plant; in this drawing the arrows show the air flows that are used to determine the movement and/or collection of the residues produced by processing the paper webs.

As better shown in FIG. 4, the electric motors (M) operating the winding rollers provided in the logs winding station (13), as well as any other motors of the rewinder (1), can be placed outside the suction chamber (C), in an area that is not affected by processing residues. In this way, said motors (M) are in a cleaner zone and are not influenced by the residues of the paper processing. On the contrary, in a traditional system the motors must be sized considering the probable difficulty in maintaining a correct operating temperature due to the presence of the residues that cover the motors and the relative cooling fins or fans.

FIG. 4 shows a possible embodiment of a plant (100) in accordance with the present invention. The system (100) is arranged inside a cabin (110) provided with external walls (PE) which separate it and isolate it from the remaining part of the industrial building (111) hosting the plant. In this way, a containment chamber of the entire paper converting plant (100) is defined. The paper converting plant (100) is made up of a plurality of machines (1, 101, 102). In FIG. 4, the machine (1) is a rewinder, while the other machines (101) and (102) are represented by schematic blocks. The machines (101) and (102) may be, for example, an embosser, a printing unit, an unwinding unit, etc. More generally, the machines inserted in the plant are machines configured to perform a physical transformation of the web paper material (W) consisting of one or more unwinding, rolling, embossing, collating, printing or cutting operations. The embossing can be combined with the sizing of the paper material in a single unit. Printing can be performed by a printing unit placed upstream of an embosser, a machine that embosses the material (100). The logs can be cut using a cutting machine that cuts the logs produced by the rewinder.

Inside the cabin (110) the rewinding machine (1) is delimited by the walls (P) so as to form the suction chamber (C) as previously described; the other machines (101, 102) may be provided with similar containment chambers, not illustrated for the sake of simplicity. In practice, one or more of the paper converting machines forming the implant (100) may be provided with a substantially closed chamber (that is, open only in correspondence with openings used for the entry and exit of the material to be treated) within which a suction is created with respect to the external environment, in order to convey the residues to a specific point or area, where they can be advantageously collected and/or removed.

The containment and recovery of the residues can be increased and optimized thanks to a particular arrangement of the air flow streams schematically represented by the arrows in the drawing. The arrow (F1) indicates the air flow in the direction shed (111)-machine (1), the arrow (F2) indicates the air flow in the direction of cab (110)-machine (1), while the arrow (F3)) indicates the air flow in the direction shed (111)-cabin (110). In practice, the suction means and the walls delimiting the suction chambers determine a pressure difference capable of moving the residues along a desired direction, or directing them towards collection and/or withdrawal points as the channel suction (A) described above. Also, in the construction of the cab (110) and of the spaces containing the machines (101, 102), the walls (P) can be arranged so as to keep the motors (M) outside the respective suction chambers.

The machines (101, 102) can be contained together with the machine (1) inside a single cabin (110), as in the example of FIG. 4, or a cabin can be provided for each machine forming the plant.

Another aspect of the present invention relates to the advantageous distribution of the flows which determine the downward movement of the residues, in particular as regards the balanced division of the flows into the two zones defined by the web (W) inside the containment chamber (C). Inn FIG. 1, the web (W) of paper material being processed divides the entire chamber (C) into two half-chambers (C1) and (C2) which are therefore arranged on the left FIG. 1 and FIG. 2 it is on the right. Correspondingly, the vertical flows of air directed downwards due to the fact that the suction channel (A) is in communication with both the half-chambers (C1) and (C2), can be divided into a first or left airflow (VS) and a second or right airflow, as shown in FIG. 2. Said flows (VS) and (VD) pass, respectively, on the left and on the right in the drawing with respect to the station for forming the logs (13). Upstream of the station (13) with respect to the direction (WP) along which the web (W) comes, the first airflow (VS) passes through the inlet zone (12) of the cores (2) and, correspondingly, the second flow (VD) goes through the unloading area (14) of the logs (3) located downstream of the station (13). The components of the rewinder (1) arranged at said areas, as indicated above, can be sized and shaped so as not to differentiate the descending (VS) and (VD) flows. One of their possible embodiments is shown in FIG. 7 which is a schematic plan view.

Figure 7:
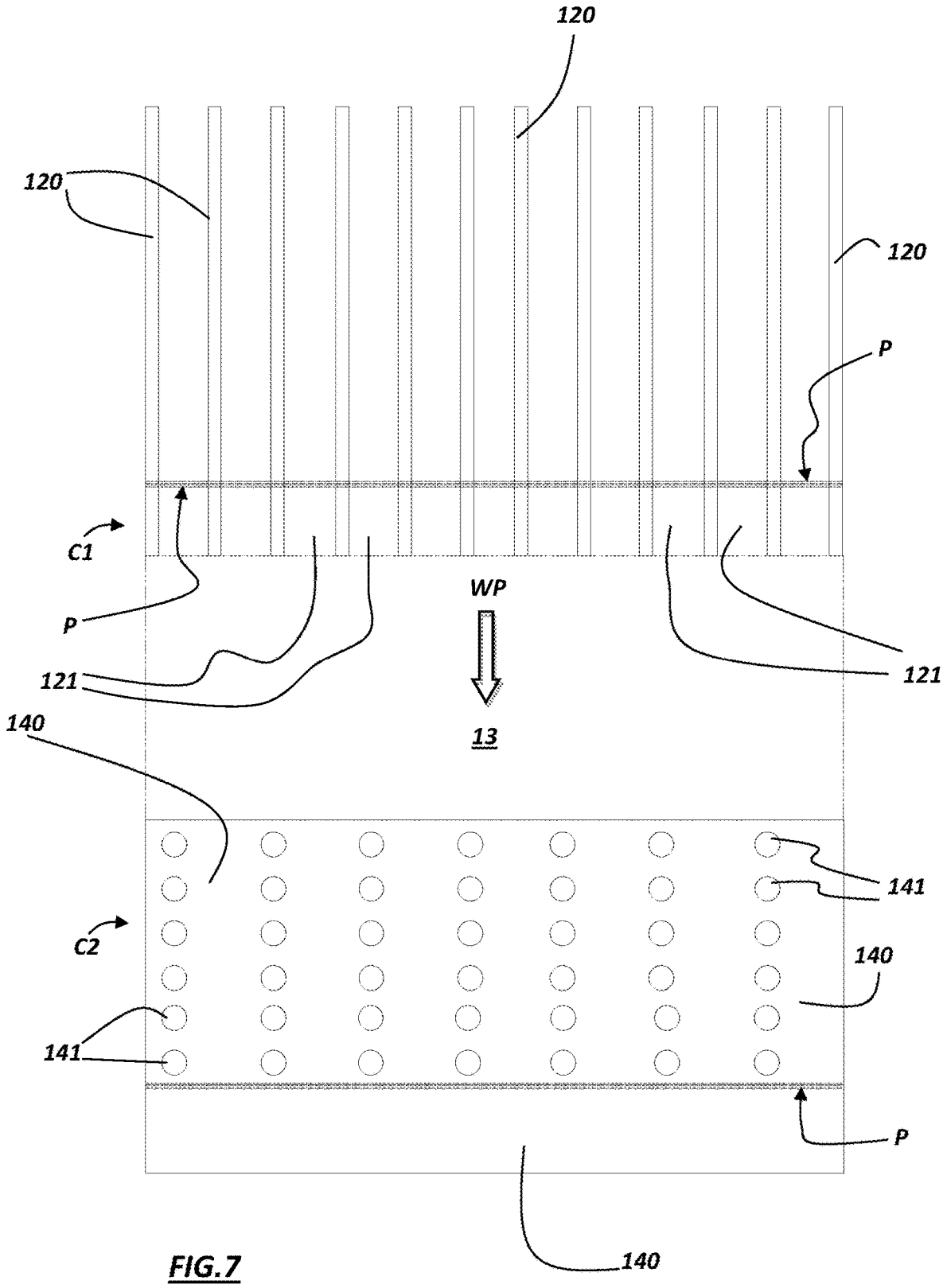
FIG. 7 is a schematic top plan view of some details of the embodiment shown in FIGS. 1-3.

In FIG. 7 the block (13) represents the station for forming the logs (13) which divides the upstream zone (input zone 12) from the downstream zone (exit area 14). The upstream zone, which is in the upper part of FIG. 7, corresponds to the lower portion of the chamber (C1) which in the drawing is delimited at the top by the wall (P) and at the bottom by the station (13); the downstream zone, which is in the lower part of FIG. 7, corresponds to the lower portion of the chamber (C2) which is delimited at the top by the station (13) and at the bottom by the wall (P).

In the area upstream of the winding station (13) (at the top in FIG. 7) the lower portion of the chamber (C1) is crossed by a plurality of guides (120) which are visible in the plan view because they are above the belts (122). The guides (120) and the belts (122) are spaced apart from one another in a manner known per se to support the cores (2) directed towards the winding station (13), leaving free spaces (121). The flow (VS) in its downward path passes through the spaces (121) of the inlet section (12) of the cores upstream of the logs forming station (13).

In the area located downstream of the station (13) (at the bottom in FIG. 7) the lower portion of the chamber (C2) is delimited below by the chute (140) used for unloading the logs (3). Advantageously, the chute (140) is provided with a plurality of holes (141) for the passage of the airflow (VD) and the total surface of the holes (141) substantially corresponds to the sum of the areas of said free spaces (121) of the entry section (12); in this way the passage of the two flows (VS) and (VD) through the inlet section of the cores and respectively through the discharge section of the logs inside the chamber (C) will be impeded substantially at a same extent and therefore there will not be appreciable speed gradient between the two flows (VS) and (VD) in the horizontal direction.

In other words, the plant object of the invention is provided with means for controlling the vertical air flows (VS, VD) inside the half-chambers (C1) and (C2) able to determine flows of equal entity in the semi-chambers (C1) and (C2) and therefore interactions of the same entity on the two sides of the tape (W). Advantageously, the zero gradient in the horizontal direction allows for optimal residues suction without negatively affecting the treatment of the web being processed.

The means for controlling the airflows inside the half-chambers (C1) and (C2) can be made differently than disclosed above, provided that they are capable of determining vertical flows of air (VS, VD) of the same entity in the half-chambers (C1) and (C2).

In accordance with the present invention, the control of vertical air flows (VS, VD) is achievable through the openings (121, 141) provided in the inlet section of the cores upstream of the logs forming station (13) and respectively in the section for unloading the logs downstream of the same forming station (13); these openings (121, 141) are dimensioned in such a way as to determine identical vertical flow rates of air (VS, VD) upstream and downstream of the station (13), in the half-chambers (C1, C2) so that the pressure exerted by the air on the two sides of the web (W) inside the chamber (C) is practically the same. As previously stated, the total area of the holes (141) substantially corresponds to the total area of the openings (121) inside the suction chamber (C).

The invention is not limited to the embodiments as disclosed and illustrated, but it can be modified remaining within the scope of the appended claims.

The invention claimed is:

1. A paper converting plant for converting paper webs, comprising:

a rewinder that is adapted to produce paper logs and has an inlet for feeding a paper web, a winding station where the paper logs are formed and an exit station for unloading the finished logs, wherein the rewinder is provided with a plurality of walls delimiting a chamber inside which the paper logs are formed, and an air suction channel disposed and acting at a lower part of said chamber, said air suction channel being adapted to exert a suction that causes the formation of an air flow directed from the top to the bottom inside the chamber, wherein said chamber is subdivided into two semi-chambers both communicating with the air suction channel such that a vertical air flow directed downwards is generated in each of them, said chamber being provided with regulating means for regulating said vertical air flows to provide vertically oriented identical air flow rates in the semi-chambers.

2. The plant according to claim 1, wherein said air suction channel has an opening extending throughout the width of rewinder.

3. The plant according to claim 1, wherein said rewinder comprises electric motors arranged outside the chamber.

4. The plant according to claim 1, wherein said walls are inclined such that the containment chamber is narrowed at its bottom, in correspondence of said air suction channel.

5. The plant according to claim 1, wherein said air suction channel is connected downstream to an air filtering device.

6. The plant according to claim 1, wherein said air channel is connected downstream to an air filtering device and then to an inlet disposed at the top of said chamber to enter filtered air in the same chamber.

7. The plant according to claim 1, further comprising a containment cabin adapted to delimit the environment surrounding the plant from a remaining part of a shed in which the same plant is located.

8. The plant according to claim 7, wherein said chamber is inside said containment cabin.

9. The plant according to claim 8, wherein the motors of said rewinder are external to said containment cabin.

10. The plant according to claim 1, wherein the walls of the containment chamber are provided with removable or openable doors provided with respective activation means.

11. The plant according to claim 1, further comprising residues separation means for separating possible residues carried by said air flows according to the mass and/or the size of the residues themselves.

12. The plant according to claim 11, wherein said residues separation means comprise a connecting channel connecting said chamber to said air suction channel, a container located at the bottom of said connection channel, and air blowing means adapted to convey a part of said residues towards the suction channel, the air suction channel being arranged laterally with respect to an exit direction of the residues from the containment chamber, said connecting channel having a lower part communicating with the container.

13. The plant according to claim 1, wherein said chamber is divided into two semi-chambers and by a paper web being converted, said flows of equal amount in the two semi-chambers and determining a pressure of the same amount on the two sides of the paper web.

14. The plant according to claim 1, wherein said means for regulating said air flows comprise perforated bodies having a same area and arranged in each of said semi-chambers in zones crossed by said air flows.

* * * * *